US010799006B2

(12) United States Patent
Durity

(10) Patent No.: US 10,799,006 B2
(45) Date of Patent: Oct. 13, 2020

(54) HAIR TWISTING SYSTEM

(71) Applicant: Noel Durity, San Diego, CA (US)

(72) Inventor: Noel Durity, San Diego, CA (US)

( * ) Notice: Subject to any disclaimer, the term of this patent is extended or adjusted under 35 U.S.C. 154(b) by 0 days.

(21) Appl. No.: 16/442,218

(22) Filed: Jun. 14, 2019

(65) Prior Publication Data

US 2019/0298029 A1 Oct. 3, 2019

Related U.S. Application Data

(63) Continuation of application No. 15/819,094, filed on Nov. 21, 2017, now Pat. No. 10,368,623.

(51) Int. Cl.
*A45D 2/00* (2006.01)
*A45D 7/00* (2006.01)

(52) U.S. Cl.
CPC ..... *A45D 2/00* (2013.01); *A45D 2002/006* (2013.01); *A45D 2007/002* (2013.01); *A45D 2007/004* (2013.01)

(58) Field of Classification Search
CPC ..... A45D 24/12; A45D 24/02; A45D 24/14; A45D 2/00; A45D 2/18; A45D 2/2492; A45D 2200/006; A45D 2002/006; A46B 2200/104; A46B 5/024; A46B 5/02; A46B 9/005
USPC ..... 132/150; 15/143.1; 473/524, 459, 528, 473/540
See application file for complete search history.

(56) References Cited

U.S. PATENT DOCUMENTS 4,500,939 A * 2/1985 Gueret ..... A46B 3/005 15/187
5,551,457 A * 9/1996 Williamson ..... A45D 2/22 132/248
D389,312 S * 1/1998 Porter ..... D4/104

* cited by examiner

*Primary Examiner* — Rachel R Steitz
*Assistant Examiner* — Brianne E Kalach
(74) *Attorney, Agent, or Firm* — John D. Tran; Rhema Law Group

(57) ABSTRACT

A hair twisting system and method of can include: a frame having an annular shape, the frame defining a frame inner surface, a frame outer surface, and a frame front surface; a handle extending from a proximal end of the frame in a direction away from the frame, the handle including side walls which converge toward one another in the proximal direction to define a proximal tip, where the side walls define an exterior griping surface and are separated by an opening in a proximal portion thereof to provide an interior griping surface; and strings extending linearly between opposing portions of the frame inner surface, wherein the strings intersect to form a grid network defining openings between adjacent strings, where the intersections are moveable.

20 Claims, 7 Drawing Sheets

HAIR TWISTING SYSTEM

CROSS-REFERENCE TO RELATED APPLICATIONS

This is a continuation of U.S. patent application Ser. No. 15/819,904 filed Nov. 21, 2017, which claims priority benefit to all common subject matter of U.S. Provisional Patent Application 62/428,021 filed Nov. 30, 2016. The content of these applications is incorporated herein by reference in their entirety.

TECHNICAL FIELD

This disclosure relates to the hair care industry more particularly to hair care products and methods related to styling and caring for African-American hair.

BACKGROUND

The African-American hair industry represents a quickly expanding and highly varied market. One notable trend beginning in the last decade of the twentieth century was a shift away from harsh and harmful chemicals towards more natural means.

Although much development and innovation has advanced this growing market segment a need still remains for a simple, durable, portable, and washable product for creating beautiful, long lasting, natural African-American hair coils, which cannot be achieved with prior developments.

Many prior developments are longitudinal and comb-like in configuration which have heating or steaming elements for retaining the curl. These products fail to provide adequate solutions to short naturally curly hair.

Other prior developments have included brushes and combs with various types and shapes of bristles and teeth. These developments largely work to separate hair strands rather than provide a compact twist or coil of hair.

Yet other prior developments have relied on rotating elements powered by electric motors implemented with electric cords or batteries. These devices, although specifically designed to be effective with African-American hair, are implemented with excessive costs, and mechanical complexities which have multiple potential failure points.

Still other prior developments contain a sponge or sponge like material. The sponges however can maintain moisture and become dirty resulting in unsanitary applications in a user's hair.

Solutions have been long sought but prior developments have not taught or suggested any complete solutions, and solutions to these problems have long eluded those skilled in the art. Thus there remains a considerable need for devices and methods that provide simple, durable, portable, and washable product for creating beautiful, long lasting, natural African-American hair coils.

SUMMARY

A hair twisting system and methods, providing simple, durable, portable, and washable product for creating beautiful, long lasting, natural African-American hair coils, are disclosed. The hair system and methods can include: a frame having an annular shape, the frame defining a frame inner surface, a frame outer surface, and a frame front surface; a handle extending from a proximal end of the frame in a direction away from the frame, the handle including side walls which converge toward one another in the proximal direction to define a proximal tip, where the side walls define an exterior griping surface and are separated by an opening in a proximal portion thereof to provide an interior griping surface; and strings extending linearly between opposing portions of the frame inner surface, wherein the strings intersect to form a grid network defining openings between adjacent strings, where the intersections are moveable.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The hair system is illustrated in the figures of the accompanying drawings which are meant to be exemplary and not limiting, in which like reference numerals are intended to refer to like components, and in which.

DETAILED DESCRIPTION

Figure 1:
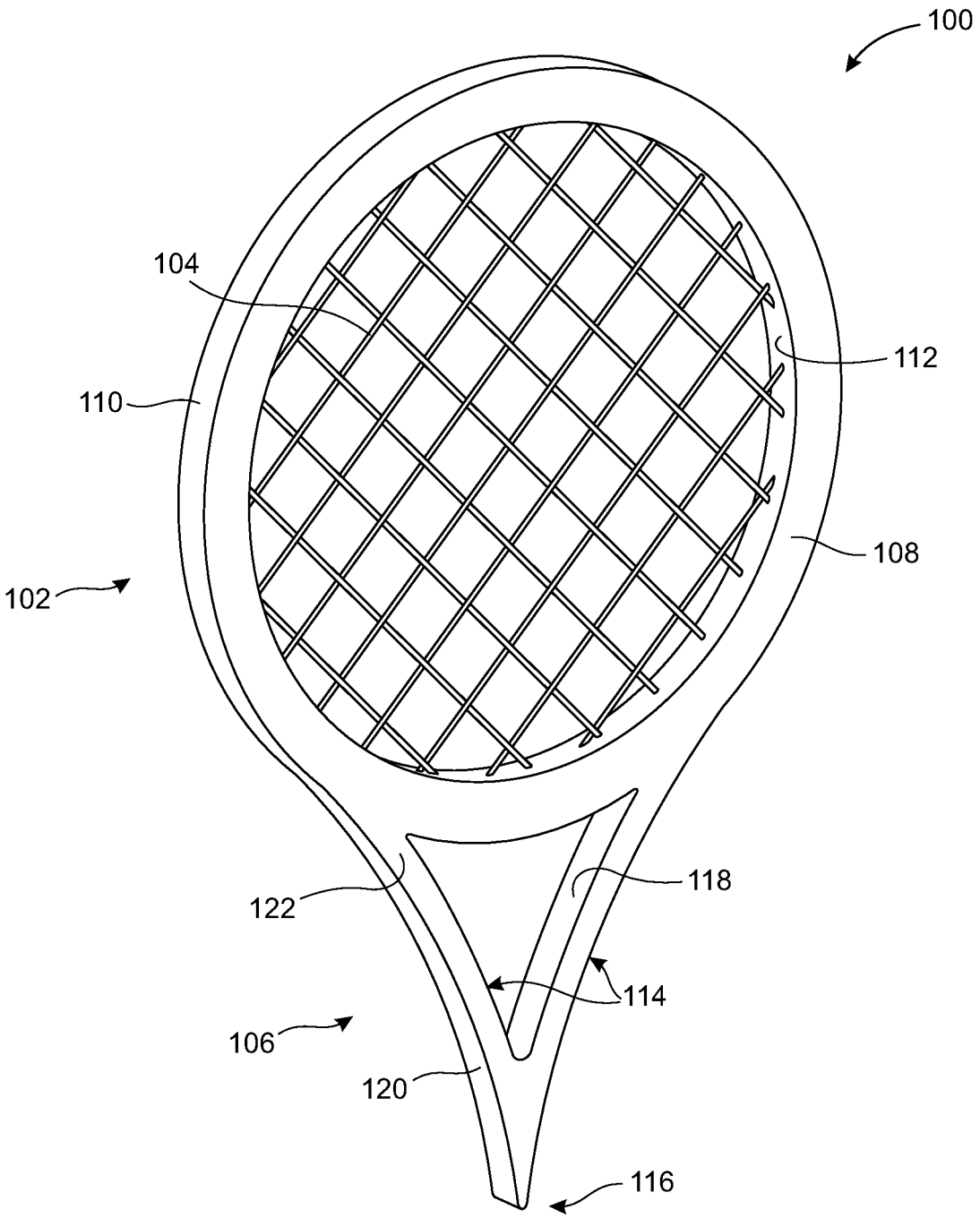
FIG. 1 is an isometric view of the hair system in a first embodiment.

In the following description, reference is made to the accompanying drawings that form a part hereof, and in which are shown by way of illustration, embodiments in which the hair system may be practiced. It is to be understood that other embodiments may be utilized and structural changes may be made without departing from the scope of the hair system.

When features, aspects, or embodiments of the hair system are described in terms of steps of a process, an operation, a control flow, or a flow chart, it is to be understood that the steps can be combined, performed in a different order, deleted, or include additional steps without departing from the hair system as described herein.

The hair system is described in sufficient detail to enable those skilled in the art to make and use the hair system and provide numerous specific details to give a thorough understanding of the hair system; however, it will be apparent that the hair system may be practiced without these specific details.

In order to avoid obscuring the hair system, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGs. Generally, the hair system can be operated in any orientation.

As used herein, the term system is defined as a device or method depending on the context in which it is used. For expository purposes, the term "vertical" as used herein is defined as a plane parallel to a front surface of the hair system, regardless of its orientation. The term "horizontal" refers to a direction perpendicular to the vertical as just defined. Terms, such as "above", "below", "bottom", "top", "side", "higher", "lower", "upper", "over", and "under", are defined with respect to the horizontal plane.

Referring now to FIG. 1, therein is shown an isometric view of the hair system 100 in a first embodiment. The hair system 100 is illustratively depicted having a frame 102 surrounding strings 104.

The frame 102 can be integrally formed with or affixed to a handle 106. It is contemplated that the frame 102 and the handle 106 can be formed of a durable washable material such as an injection molded plastic, metal, fiberglass, or a combination thereof.

The frame 102 and the handle 106 are contemplated to be formed in a size that can fit within a standard sized pants pocket. The handle 106 is depicted as being smaller than the frame 102 contributing to ease of handling, use, and storage.

It will be appreciated that the width across the frame 102 can be less than twice the width of the handle 106, at the widest part where the handle 106 intersects the frame 102, ensuring ease of manipulation and use; and, further ensuring ease of storage and carry. The frame 102 is depicted as circular.

The frame 102 is depicted as a circular shape having a frame front surface 108, a frame outer surface 110, and a frame inner surface 112. The frame front surface 108 is shown to be a vertical planar surface; however, it is contemplated that the frame front surface 108 could have an irregular surface whether it be textured, engraved, or otherwise molded.

The frame outer surface 110 and the frame inner surface 112 can be parallel with respect to each other and perpendicular to the frame front surface 108. The frame outer surface 110 can be a surface facing out away from the hair system 100 while the frame inner surface 112 can be a surface forming a hollow center and the frame inner surface 112 can face inward toward the hollow center of the frame 102.

The strings 104 can include ends extended from and terminating on opposing sides of the frame inner surface 112. The strings 104 can intersect one another at 90 degrees forming squares or diamond shapes. The strings 104 can be formed of a nylon or similar situated material, which is durable, flexible, and washable. The strings are shown to extend linearly between a first plane defined by the frame front surface 108 and a second plane defined by a frame back surface.

It is contemplated that the strings 104 can be woven or form a woven pattern meaning a woven string can extend over a first surface of a first string and over a second surface of a second string with the first surface and the second surface facing opposite directions or on opposite sides of the strings 104. It is further contemplated that the strings 104 can provide moveable intersections by being fully independent and not fixed to each other at the points where the strings 104 intersect allowing the strings to move along each other and relative to each other rather than being fixed at an intersection point.

It has been discovered that the strings being allowed to move at the intersection point, the strings being woven, or a combination thereof increases the effectiveness of the hair system 100 by allowing the strings 104 to reliably and controllably deform around locks of hair and to spring back when the hair system 100 is being twisted away from a user.

It is contemplated that the strings 104 do not contain a sponge or sponge like material which can collect and retain moisture which may harbor germs or bacteria resulting in a dirty and unsanitary comb apparatus. The strings 104 may be held within the frame 102 with string anchors, knots, or may be threaded through the frame 102 from the frame inner surface 112 to the frame outer surface 110.

The strings 104 are depicted as evenly spaced creating even squares or diamonds between the frame inner surface 112. The handle 106 is depicted extended down away from the frame 102 and the strings 104. The strings 104 are shown extending linearly between a first plane defined by the flat frame front surface 108 and a second plane defined by a flat frame back surface.

The handle 106 can include side structures 114 extending from the frame 102 down to form a handle tip 116 at a location remote from the frame 102. The side structures 114 can be spaced apart when in contact with the frame and provide an interior griping surface 118 and an exterior griping surface 120. The interior griping surface 118 and the exterior griping surface 120 can be parallel surfaces with respect to each other. The interior griping surface 118 is shown defining an interior gripping opening formed between the interior gripping surface 118 of the side structures 114 of the handle 106.

The interior griping surface 118 can also enable a user to insert a finger and spin the hair system 100 about the finger without loosing control of the hair system 100. Perpendicular to the interior griping surface 118 and the exterior griping surface 120, the handle 106 can include a handle front surface 122.

The handle front surface 122 can be coplanar with the frame front surface 108 providing a smooth transition between the frame 102 and the handle 106 contributing to an elegant yet functional solution for griping, pressing, twisting, and spinning. It is contemplated that the handle tip 116 can be implemented as a pick for undoing any undesired hair twists or styling.

The handle tip 116 is slightly rounded so as not to damage the scalp of a user. Further in other contemplated embodiments the exterior griping surface 120 near the handle tip 116 can narrow providing a smaller cross-section and providing a more refined handle tip 116 for delicate picking.

It will be appreciated that the handle 106 has a smaller width and length than the frame 102. It will further be appreciated that the handle 106 can have a smooth transition to the frame 102 to enable multiple gripping angles and hand positions fully enabling precise, nuanced, and intuitive maneuvering of the hair system 100.

Figure 2:
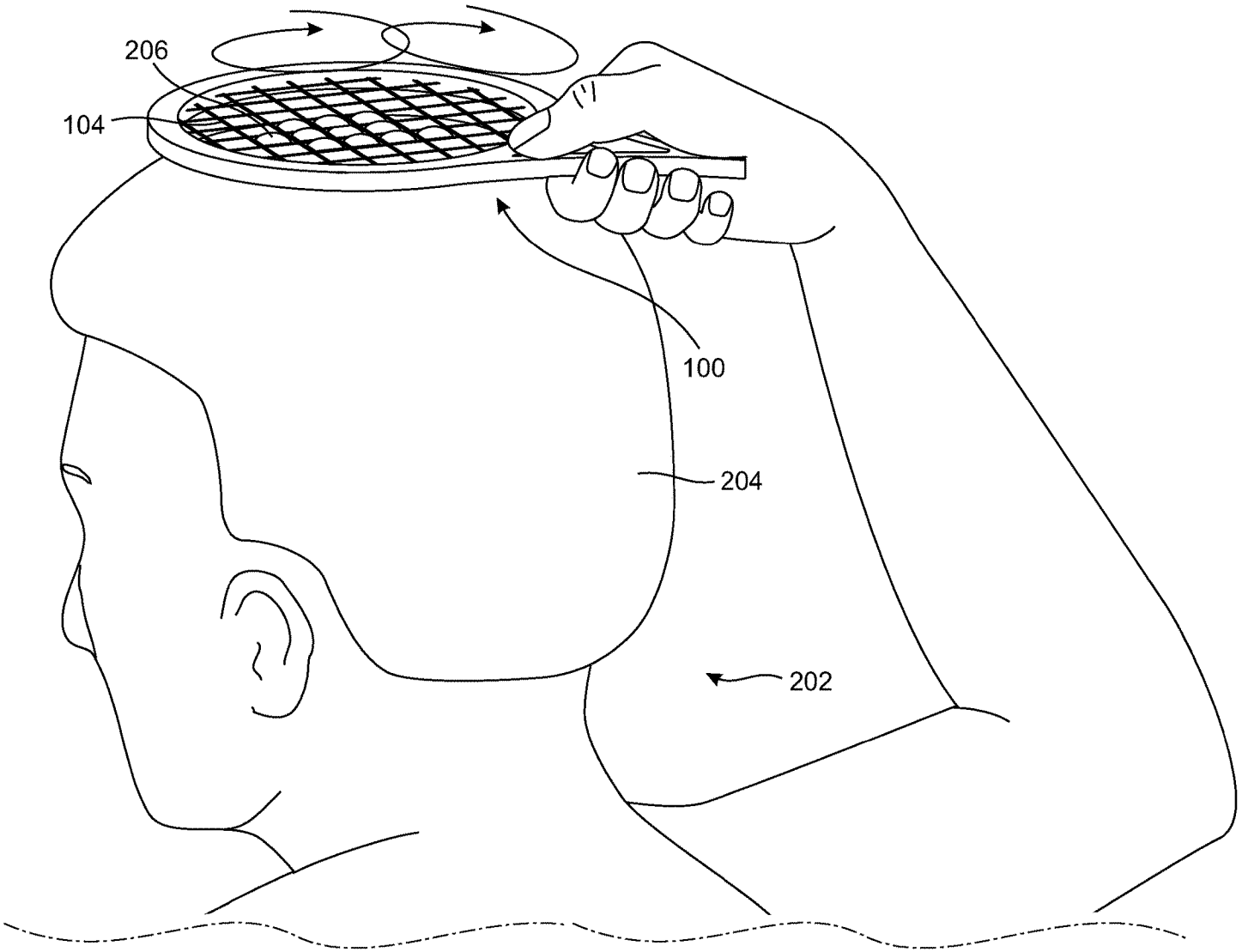
FIG. 2 is an isometric view of the hair system of FIG. 1 in a beginning phase of implementation.

Referring now to FIG. 2, therein is shown an isometric view of the hair system 100 of FIG. 1 in a beginning phase of implementation. A user 202 can be seen holding the hair system 100 on the user's hair 204.

The strings 104 of the hair system 100 can be pressed into the hair 204 of the user 202 down to the user's 202 scalp and separate the hair 204 into locks of hair 206. The locks of hair 206 can extend from the user's 202 scalp up through the spaces between the strings 104.

The strings 104 can grab or exert force on the roots and length of the user's 202 hair 204, twisting the user's 202 hair 204 as the hair system 100 is twisted. Illustratively, the hair system 100 can be pressed down into the user's 202 hair 204.

The user 202 can then rotate the hair system 100 and simultaneously move the hair system 100 out away from the user's 202 scalp until the hair system 100 disengages from the hair 204. This motion can twist the locks of hair 206 between the strings 104 into small twisted locks as shown in FIG. 3.

It is contemplated that the hair system 100 could be twisted in a clockwise or counter-clockwise direction. It is further contemplated that the motion of pressing the hair system 100 into the hair and rotating the hair system 100 while moving it out away from the user 202 can be repeated until the locks of hair 206 are compact twisted locks of hair 206.

Figure 3:
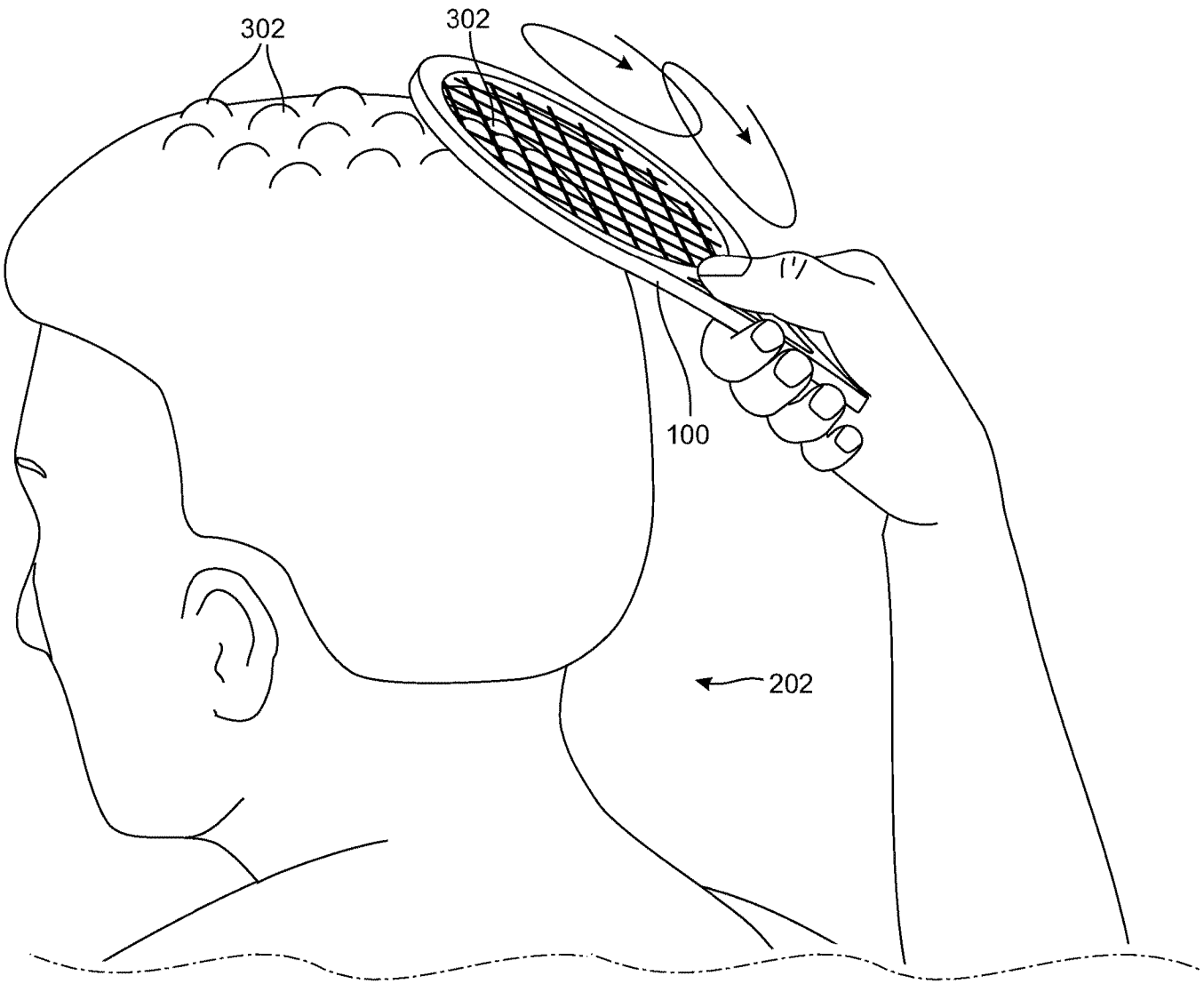
FIG. 3 is an isometric view of the hair system of FIG. 1 in an intermediate phase of implementation.

Referring now to FIG. 3, therein is shown an isometric view of the hair system 100 of FIG. 1 in an intermediate phase of implementation. The user 202 is depicted having twisted locks of hair 302 after the twisting motion of the hair system 100 as described with regard to FIG. 2.

Figure 4:
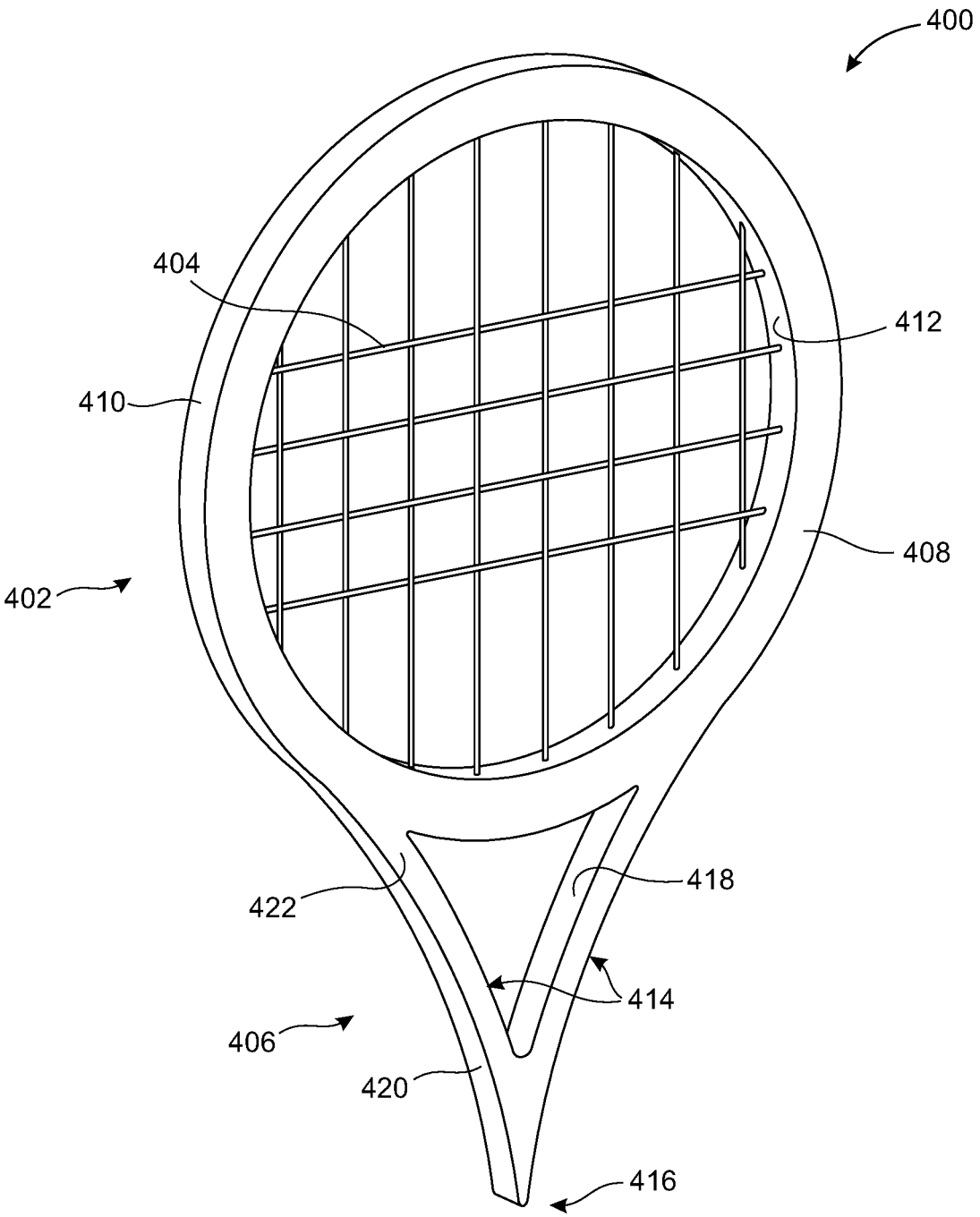
FIG. 4 is an isometric view of the hair system in a second embodiment.

Referring now to FIG. 4, therein is shown an isometric view of the hair system 400 in a second embodiment. The hair system 400 is illustratively depicted having a frame 402 surrounding strings 404.

The frame 402 can be integrally formed with or affixed to a handle 406. It is contemplated that the frame 402 and the handle 406 can be formed of a durable washable material such as an injection molded plastic, metal, fiberglass, or a combination thereof.

The frame 402 and the handle 406 are contemplated to be formed in a size that can fit within a standard sized pants pocket. The handle 406 is depicted as being smaller than the frame 402 contributing to ease of handling, use, and storage.

The frame 402 is depicted as a circular shape having a frame front surface 408, a frame outer surface 410, and a frame inner surface 412. The frame front surface 408 is shown to be a vertical planar surface; however, it is contemplated that the frame front surface 408 could have an irregular surface whether it be textured, engraved, or otherwise shaped.

The frame outer surface 410 and the frame inner surface 412 can be parallel with respect to each other and perpendicular to the frame front surface 408. The frame outer surface 410 can be a surface facing out away from the hair system 400 while the frame inner surface 412 can be a surface forming or bordering a hollow center and the frame inner surface 412 can face inward toward the hollow center of the frame 402.

The strings 404 can be extended from and terminate within the frame inner surface 412. The strings 404 can intersect one another at 90 degrees forming squares or can form elongated shapes with one side formed by the frame inner surface 412. The strings 404 can be formed of a nylon or similar situated material, which is durable, flexible, and washable.

It is contemplated that the strings 404 can be woven or form a woven pattern meaning a woven string can extend over a first surface of a first string and over a second surface of a second string with the first surface and the second surface facing opposite directions or on opposite sides of the strings 404. It is further contemplated that the strings 404 can provide moveable intersections by being fully independent and not fixed to each other at the points where the strings 404 intersect allowing the strings to move along each other and relative to each other rather than being fixed at an intersection point.

It has been discovered that the strings being allowed to move at the intersection point, the strings being woven, or a combination thereof increases the effectiveness of the hair system 400 by allowing the strings 404 to reliably and controllably deform around locks of hair and to spring back when the hair system 400 is being twisted away from a user.

It is contemplated that the strings 404 and the frame 402 do not contain a sponge or sponge like material which can collect and retain moisture which may harbor germs or bacteria resulting in a dirty and unsanitary comb apparatus. The strings 404 may be held within the frame 402 with string anchors, knots, or may be threaded through the frame 402 from the frame inner surface 412 to the frame outer surface 410.

The strings 404 are depicted as evenly spaced creating even squares between the strings 404. The strings 404 are further depicted as unevenly spaced creating elongated shapes between the strings 404 and the frame inner surface 412. The handle 406 is depicted extended down away from the frame 402 and the strings 404.

The handle 406 can include side structures 414 extending from the frame 402 down to form a handle tip 416. The side structures 414 can provide an interior griping surface 418 and an exterior griping surface 420. The interior griping surface 418 and the exterior griping surface 420 can be parallel surfaces with respect to each other.

The interior griping surface 418 can also enable a user to insert a finger and spin the hair system 400 about the finger without loosing control of the hair system 400. Perpendicular to the interior griping surface 418 and the exterior griping surface 420, the handle 406 can include a handle front surface 422.

The handle front surface 422 can be coplanar with the frame front surface 408 providing a smooth transition between the frame 402 and the handle 406 contributing to an elegant yet functional solution for griping, pressing, twisting, and spinning. It is contemplated that the handle tip 416 can be implemented as a pick for undoing any undesired hair twists or styling.

The handle tip 416 is slightly rounded so as not to damage the scalp of a user. Further in other contemplated embodiments the exterior griping surface 420 near the handle tip 416 can narrow providing a smaller cross-section and providing a more refined handle tip 416 for delicate picking.

It will be appreciated that the handle 406 has a smaller width and length than the frame 402. It will further be appreciated that the handle 406 can have a smooth transition to the frame 402 to enable multiple gripping angles and hand positions fully enabling precise, nuanced, and intuitive maneuvering of the hair system 400.

Figure 5:
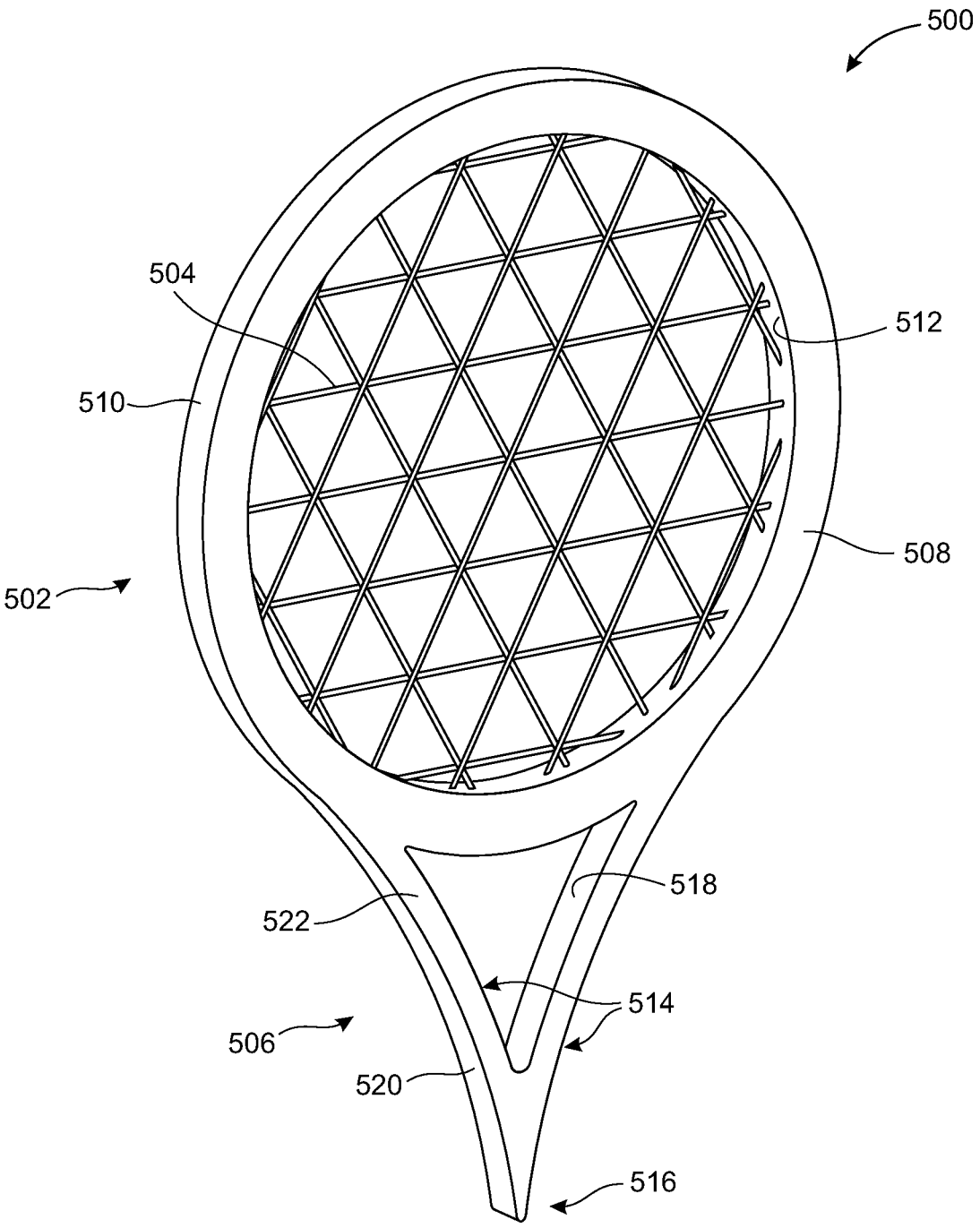
FIG. 5 is an isometric view of the hair system in a third embodiment.

Referring now to FIG. 5, therein is shown an isometric view of the hair system 500 in a third embodiment. The hair system 500 is illustratively depicted having a frame 502 surrounding strings 504.

The frame 502 can be integrally formed with or affixed to a handle 506. It is contemplated that the frame 502 and the handle 506 can be formed of a durable washable material such as an injection molded plastic, metal, fiberglass, or a combination thereof.

The frame 502 and the handle 506 are contemplated to be formed in a size that can fit within a standard sized pants pocket. The handle 506 is depicted as being smaller than the frame 502 contributing to ease of handling, use, and storage.

The frame 502 is depicted as a circular shape having a frame front surface 508, a frame outer surface 510, and a frame inner surface 512. The frame front surface 508 is shown to be a vertical planar surface; however, it is contemplated that the frame front surface 508 could have an irregular surface whether it be textured, engraved, or otherwise shaped.

The frame outer surface 510 and the frame inner surface 512 can be parallel with respect to each other and perpendicular to the frame front surface 508. The frame outer surface 510 can be a surface facing out away from the hair system 500 while the frame inner surface 512 can be a surface forming or bordering a hollow center and the frame inner surface 512 can face inward toward the hollow center of the frame 502.

The strings 504 can be extended from and terminate within the frame inner surface 512. The strings 504 can intersect one another forming triangles or can form shapes with one side formed by the frame inner surface 512. The strings 504 can be formed of a nylon or similar situated material, which is durable, flexible, and washable.

It is contemplated that the strings 504 can be woven or form a woven pattern meaning a woven string can extend over a first surface of a first string and over a second surface of a second string with the first surface and the second surface facing opposite directions or on opposite sides of the strings 504. It is further contemplated that the strings 504 can provide moveable intersections by being fully independent and not fixed to each other at the points where the strings 504 intersect allowing the strings to move along each other and relative to each other rather than being fixed at an intersection point.

It has been discovered that the strings being allowed to move at the intersection point, the strings being woven, or a combination thereof increases the effectiveness of the hair system 500 by allowing the strings 504 to reliably and controllably deform around locks of hair and to spring back when the hair system 500 is being twisted away from a user.

It is contemplated that the strings 504 and the frame 502 do not contain a sponge or sponge like material which can collect and retain moisture which may harbor germs or bacteria resulting in a dirty and unsanitary comb apparatus. The strings 504 may be held within the frame 502 with string anchors, knots, or may be threaded through the frame 502 from the frame inner surface 512 to the frame outer surface 510.

The strings 504 are depicted as evenly spaced creating even triangles between the strings 504. The strings 504 are further depicted creating elongated shapes between the strings 504 and the frame inner surface 512. The handle 506 is depicted extended down away from the frame 502 and the strings 504.

The handle 506 can include side structures 514 extending from the frame 502 down to form a handle tip 516. The side structures 514 can provide an interior griping surface 518 and an exterior griping surface 520. The interior griping surface 518 and the exterior griping surface 520 can be parallel surfaces with respect to each other.

The interior griping surface 518 can also enable a user to insert a finger and spin the hair system 500 about the finger without loosing control of the hair system 500. Perpendicular to the interior griping surface 518 and the exterior griping surface 520, the handle 506 can include a handle front surface 522.

The handle front surface 522 can be coplanar with the frame front surface 508 providing a smooth transition between the frame 502 and the handle 506 contributing to an elegant yet functional solution for griping, pressing, twisting, and spinning. It is contemplated that the handle tip 516 can be implemented as a pick for undoing any undesired hair twists or styling.

The handle tip 516 is slightly rounded so as not to damage the scalp of a user. Further in other contemplated embodiments the exterior griping surface 520 near the handle tip 516 can narrow providing a smaller cross-section and providing a more refined handle tip 516 for delicate picking.

It will be appreciated that the handle 506 has a smaller width and length than the frame 502. It will further be appreciated that the handle 506 can have a smooth transition to the frame 502 to enable multiple gripping angles and hand positions fully enabling precise, nuanced, and intuitive maneuvering of the hair system 500.

Figure 6:
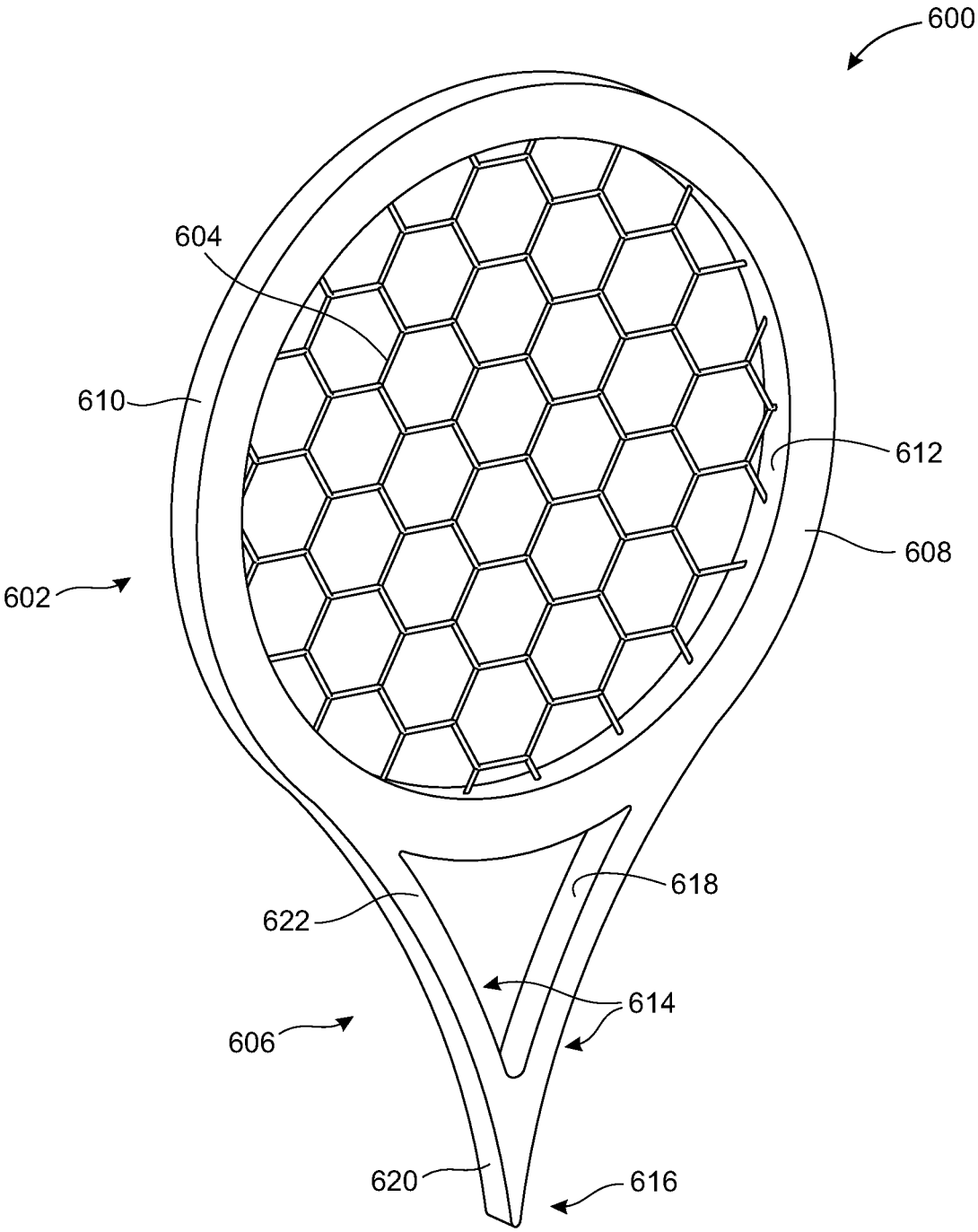
FIG. 6 is an isometric view of the hair system in a fourth embodiment.

Referring now to FIG. 6, therein is shown an isometric view of the hair system 600 in a fourth embodiment. The hair system 600 is illustratively depicted having a frame 602 surrounding strings 604.

The frame 602 can be integrally formed with or affixed to a handle 606. It is contemplated that the frame 602 and the handle 606 can be formed of a durable washable material such as an injection molded plastic, metal, fiberglass, or a combination thereof.

The frame 602 and the handle 606 are contemplated to be formed in a size that can fit within a standard sized pants pocket. The handle 606 is depicted as being smaller than the frame 602 contributing to ease of handling, use, and storage.

The frame 602 is depicted as a circular shape having a frame front surface 608, a frame outer surface 610, and a frame inner surface 612. The frame front surface 608 is shown to be a vertical planar surface; however, it is contemplated that the frame front surface 608 could have an irregular surface whether it be textured, engraved, or otherwise shaped.

The frame outer surface 610 and the frame inner surface 612 can be parallel with respect to each other and perpendicular to the frame front surface 608. The frame outer surface 610 can be a surface facing out away from the hair system 600 while the frame inner surface 612 can be a surface forming or bordering a hollow center and the frame inner surface 612 can face inward toward the hollow center of the frame 602.

The strings 604 can be extended from and terminate within the frame inner surface 612. The strings 604 can intersect one another forming hexagons or can form shapes with one side formed by the frame inner surface 612. The strings 604 can be formed of a nylon or similar situated material, which is durable, flexible, and washable.

It is contemplated that the strings 604 can be woven or form a woven pattern meaning a woven string can extend over a first surface of a first string and over a second surface of a second string with the first surface and the second surface facing opposite directions or on opposite sides of the strings 604. It is further contemplated that the strings 604 can provide moveable intersections by being fully independent and not fixed to each other at the points where the strings 604 intersect allowing the strings to move along each other and relative to each other rather than being fixed at an intersection point.

It has been discovered that the strings being allowed to move at the intersection point, the strings being woven, or a combination thereof increases the effectiveness of the hair system 600 by allowing the strings 604 to reliably and controllably deform around locks of hair and to spring back when the hair system 600 is being twisted away from a user.

It is contemplated that the strings 604 and the frame 602 do not contain a sponge or sponge like material which can collect and retain moisture which may harbor germs or bacteria resulting in a dirty and unsanitary comb apparatus. The strings 604 may be held within the frame 602 with string anchors, knots, or may be threaded through the frame 602 from the frame inner surface 612 to the frame outer surface 610.

The strings 604 are depicted as evenly spaced creating even hexagons between the strings 604. The strings 604 are further depicted creating elongated shapes between the strings 604 and the frame inner surface 612. The handle 606 is depicted extended down away from the frame 602 and the strings 604.

The handle 606 can include side structures 614 extending from the frame 602 down to form a handle tip 616. The side structures 614 can provide an interior griping surface 618 and an exterior griping surface 620. The interior griping surface 618 and the exterior griping surface 620 can be parallel surfaces with respect to each other.

The interior griping surface 618 can also enable a user to insert a finger and spin the hair system 600 about the finger without loosing control of the hair system 600. Perpendicular to the interior griping surface 618 and the exterior griping surface 620, the handle 606 can include a handle front surface 622.

The handle front surface 622 can be coplanar with the frame front surface 608 providing a smooth transition between the frame 602 and the handle 606 contributing to an elegant yet functional solution for griping, pressing, twisting, and spinning. It is contemplated that the handle tip 616 can be implemented as a pick for undoing any undesired hair twists or styling.

The handle tip 616 is slightly rounded so as not to damage the scalp of a user. Further in other contemplated embodiments the exterior griping surface 620 near the handle tip 616 can narrow providing a smaller cross-section and providing a more refined handle tip 616 for delicate picking.

It will be appreciated that the handle 606 has a smaller width and length than the frame 602. It will further be appreciated that the handle 606 can have a smooth transition to the frame 602 to enable multiple gripping angles and hand positions fully enabling precise, nuanced, and intuitive maneuvering of the hair system 600.

Figure 7:
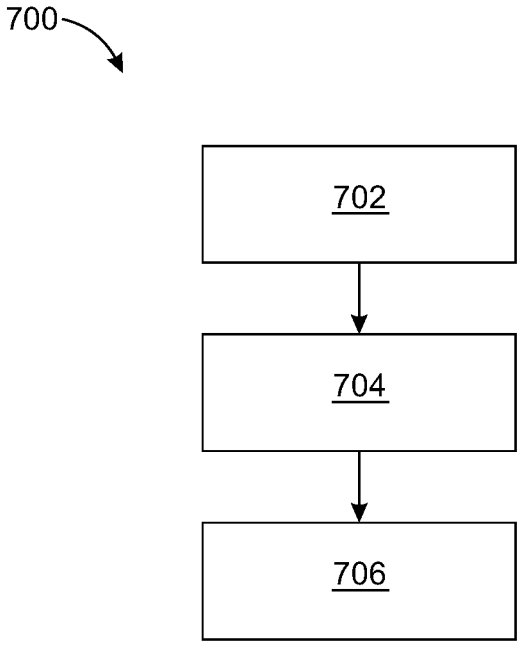
FIG. 7 is a flow chart for manufacturing the hair system of this disclosure.

Referring now to FIG. 7, therein is shown a flow chart 700 for a manufacturing method of the hair system of this disclosure. The manufacturing method can include providing a frame in a block 702, the frame including a frame inner surface, a frame outer surface, and a frame front surface; coupling strings to the frame and extended between portions of the frame interior surface, the strings define areas between the strings, the strings providing woven moveable intersections, the strings configured to be: pressed down into hair towards a scalp, and then simultaneously moved out away from the scalp while being rotated until the strings disengage from the hair for creating twisted locks in a block 704; and coupling a handle to the frame, the handle including side structures, the side structures providing an interior griping surface between the side structures and an exterior griping surface in a block 706.

Thus, it has been discovered that the hair system furnishes important and heretofore unknown and unavailable solutions, capabilities, and functional aspects.

The resulting configurations are straightforward, cost-effective, uncomplicated, highly versatile, accurate, sensitive, and effective, and can be implemented by adapting known components for ready, efficient, and economical manufacturing, application, and utilization.

While the hair system has been described in conjunction with a specific best mode, it is to be understood that many alternatives, modifications, and variations will be apparent to those skilled in the art in light of the preceding description.

Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A hair twisting system comprising:

a frame having an annular shape, the frame defining a frame inner surface, a frame outer surface, and a frame front surface;

a handle extending from a proximal end of the frame in a direction away from the frame, the handle including side walls, the side walls being spaced apart when in contact with the frame and converge to define a proximal tip at a location remote from the frame, the side walls of the handle further define an interior gripping surface and an exterior griping surface, the interior gripping surface defining an interior gripping opening formed between the interior gripping surface of the side walls of the handle; and strings having ends, each of the strings having the ends thereof connected to opposing sides of the frame inner surface, where the strings extend linearly between a first plane defined by the frame front surface and a second plane defined by a frame back surface, wherein the strings intersect to form a grid network having openings between the strings, and where intersections are formed by the strings overlapping;

wherein:

the frame is configured to be placed toward a head of a user such that the strings extend toward a scalp of the user;

the strings are configured to press into hair of the user towards the scalp of the user thereby causing the strings to reliably and controllably deform around locks of the hair;

the handle configured to rotate the frame while the hair is held between the strings; and the frame further configured to be moved away from the scalp, causing the strings to disengage from the hair and to spring back to the grid network and leave the hair in newly formed twisted locks.

2. The system of claim 1 wherein the strings define square areas between the strings.

3. The system of claim 1 wherein the strings define triangular areas between the strings.

4. The system of claim 1 wherein the strings define diamond areas between the strings.

5. The system of claim 1 wherein the strings define hexagonal areas between the strings.

6. A hair twisting system comprising:

a frame having an annular shape, the frame defining a frame inner surface, a frame outer surface, and a frame front surface, the frame inner surface parallel to the frame outer surface, and the frame front surface perpendicular to the frame inner surface and the frame outer surface;

a handle extending from a proximal end of the frame in a direction away from the frame, the handle including side walls, the side walls being spaced apart when in contact with the frame and converge to define a proximal tip at a location remote from the frame, the side walls of the handle further define an interior gripping surface and an exterior griping surface, the interior gripping surface defining an interior gripping opening formed between the interior gripping surface of the side walls of the handle; and strings having ends, each of the strings having the ends thereof connected to opposing sides of the frame inner surface, where the strings extend linearly between a first plane defined by the frame front surface and a second plane defined by a frame back surface, wherein the strings intersect to form a grid network having openings between the strings, and where intersections are formed by the strings overlapping;

wherein:

the frame is configured to be placed toward a head of a user such that the strings extend toward a scalp of the user;

the strings are configured to press into hair of the user towards the scalp of the user thereby causing the strings to reliably and controllably deform around locks of the hair;

the handle configured to rotate the frame while the hair is held between the strings; and the frame further configured to be moved away from the scalp, causing the strings to disengage from the hair and to spring back to the grid network and leave the hair in newly formed twisted locks.

7. The system of claim 6 wherein the handle tapers with a concave surface toward a pointed handle tip.

8. The system of claim 6 wherein the strings are nylon.

9. The system of claim 6 wherein the frame width is less than twice the width of the handle for ease of use and carry.

10. The system of claim 6 wherein the frame is circular.

11. A method of manufacturing a hair twisting system comprising:

providing a frame having an annular shape, the frame defining a frame inner surface, a frame outer surface, and a frame front surface;

forming a handle extending from a proximal end of the frame in a direction away from the frame, the handle including side walls, the side walls being spaced apart when in contact with the frame and converge to define a proximal tip at a location remote from the frame, the side walls of the handle further define an interior gripping surface and an exterior griping surface, the interior gripping surface defining an interior gripping opening formed between the interior gripping surface of the side walls of the handle; and attaching strings having ends, each of the strings having the ends thereof connected to opposing sides of the frame inner surface, where the strings extend linearly between a first plane defined by the frame front surface and a second plane defined by a frame back surface, wherein the strings intersect to form a grid network having openings between the strings, and where intersections are formed by the strings overlapping;

wherein:

the frame is configured to be placed toward a head of a user such that the strings extend toward a scalp of the user;

the strings are configured to press into hair of the user towards the scalp of the user thereby causing the strings to reliably and controllably deform around locks of the hair;

the handle configured to rotate the frame while the hair is held between the strings; and the frame further configured to be moved away from the scalp, causing the strings to disengage from the hair and to spring back to the grid network and leave the hair in newly formed twisted locks.

12. The method of claim 11 wherein the strings define square areas between the strings.

13. The method of claim 11 wherein the strings define triangular areas between the strings.

14. The method of claim 11 wherein the strings define diamond areas between the strings.

15. The method of claim 11 wherein the strings define hexagonal areas between the strings.

16. The method of claim 11 wherein the frame inner surface is parallel to the frame outer surface, and the frame front surface perpendicular to the frame inner surface and the frame outer surface.

17. The method of claim 16 wherein the handle tapers with a concave surface toward a pointed handle tip.

18. The method of claim 16 wherein the strings are nylon.

19. The method of claim 16 wherein the frame width is less than twice the width of the handle for ease of use and carry.

20. The method of claim 16 wherein the frame is circular.

* * * * *